US005214450A

United States Patent [19]

Shimoda

[11] Patent Number: 5,214,450

[45] Date of Patent: May 25, 1993

[54] THERMAL INK JET RECORDING APPARATUS USING A GROUPED TRANSDUCER DRIVE

[75] Inventor: Junji Shimoda, Chigasaki, Japan

[73] Assignee: Canon Kabushiki Kaisha, Tokyo, Japan

[21] Appl. No.: 947,954

[22] Filed: Sep. 21, 1992

Related U.S. Application Data

[63] Continuation of Ser. No. 716,833, Jun. 17, 1991, abandoned.

[30] Foreign Application Priority Data

Jun. 15, 1990 [JP] Japan ..... 2-157001

[51] Int. Cl.[5] ..... B41J 2/05

[52] U.S. Cl. ..... 346/140 R

[58] Field of Search ..... 346/140 R

[56] References Cited

U.S. PATENT DOCUMENTS 4,313,124 1/1982 Hara ..... 346/140 R
4,345,262 8/1982 Shirato ..... 346/140 R
4,463,359 8/1982 Shirato ..... 346/1.1
4,723,129 2/1988 Hara ..... 346/1.1

FOREIGN PATENT DOCUMENTS 0103943 3/1984 European Pat. Off. .
0318328 5/1989 European Pat. Off. .
55-109672 8/1980 Japan .

*Primary Examiner*—Joseph W. Hartary
*Attorney, Agent, or Firm*—Fitzpatrick, Cella, Harper & Scinto

[57] ABSTRACT

An ink jet recording apparatus for an ink jet recording apparatus includes a plurality of electrothermal transducer elements for producing thermal energy for ejections of recording liquid driving circuitry for supplying electric energy to the electrothermal transducer elements in accordance with data to be recorded and a control signal, wherein the plural electrothermal transducers are grouped into plural groups, and the groups are simultaneously driven by the driving device, wherein the electrothermal transducer elements in a group are supplied with electric power in a period between maximum expansion of a bubble in a previously driven group and expiration thereof.

4 Claims, 7 Drawing Sheets

THERMAL INK JET RECORDING APPARATUS USING A GROUPED TRANSDUCER DRIVE

This application is a continuation of application Ser. No. 07/716,833 filed Jun. 17, 1991, now abandoned.

FIELD OF THE INVENTION AND RELATED ART

The present invention relates to an ink jet recording apparatus usable with an information processing apparatus as an output terminal or an ink jet recording apparatus functioning as a printer unified with an information processing apparatus, and more particularly to an ink jet recording apparatus usable with a personal computer, word processor, copying machine, facsimile machine or the like. Further particularly, the present invention relates to an ink jet recording apparatus using an electrothermal transducer to produce thermal energy contributable to ejection of the ink in accordance with image information.

An ink jet recording apparatus wherein a liquid droplet is ejected by creation of a bubble corresponding to an instantaneous change of state of the liquid by the thermal energy produced by an electrothermal transducer is disclosed in U.S. Pat. No. 4,723,129. That patent discloses a simultaneous drive system wherein plural electrothermal transducers are simultaneously driven and a nonsimultaneous driving system wherein the plural electrothermal transducers are sequentially driven with a phase difference to effect recording in an inclined fashion. A similar disclosure is made in Japanese Laid-Open Patent Application No. 109672/1980. That U.S. Patent also discloses what is called a time sharing driving system for a great number of electrothermal transducers.

However, in a recording apparatus using thermal energy, which has been put into practice, the above described simultaneous driving system has been considered to be most preferable, since it is advantageous in that high speed recording is possible.

Therefore, in most proposals in connection with ink jet recording systems, it is a premise that the driving signals are simultaneously supplied to the electrothermal transducers in accordance with recording signals.

Japanese Laid-Open Patent Application No. 109672/1980 discloses a liquid jet recording method wherein a phase difference is provided between ejections from adjacent orifices.

This structure includes an advantage that the driving current is lowered, and therefore, the voltage drop due to the wiring resistance is decreased. However, this method involves a problem that although meniscus restoration after ink ejection is quick when a small number of orifices are driven, restoration is significantly delayed when a great number of orifices are driven. For example, a meniscus restoring frequency of 9 KHz during the driving of a small number of orifices is reduced to 5 KHz when a great number of orifices are driven. Therefore, the lower frequency is set as the driving frequency of the apparatus.

It is a significant problems that the driving frequency of the entire apparatus is limited by the meniscus restoring frequency when a large number of orifices are driven, because high speed recording is generally desired in the field of printers.

SUMMARY OF THE INVENTION

Accordingly, it is a principal object of the present invention to provide an ink jet recording method and apparatus wherein the liquid droplet formation frequency is high.

It is another object of the present invention to provide an ink jet recording method and apparatus wherein the frequency of the liquid droplet formation is increased, and the accuracy of the shot positions of the recording liquid droplets is improved.

It is a further object of the present invention to provide an ink jet recording method and apparatus having a structure of a liquid passage capable of operating at high frequency.

It has been considered that the decrease of the refilling frequency upon the large number of driving arises from thermal problem, that is, the refilling time becomes longer by the increase of the meniscus retraction due to the increase of the quantity of the ejected ink because of the lowering of the viscosity of the ink by the increase of the ink temperature adjacent the motor.

However, it has been found from various experiments and considerations that the frequency can be significantly increased by properly selecting time difference between actuations for adjacent or close orifices.

According to an aspect of the present invention there is provided an ink jet recording method for an ink jet recording apparatus comprising a plurality of electrothermal transducer elements for producing thermal energies for formation of recording liquids and driving means for supplying electric energy to the electrothermal transducer elements in accordance with data to be recorded and a control signal, wherein the plural electrothermal transducers are grouped into plural groups, and the groups are simultaneously driven by the driving means, wherein the electrothermal transducer elements in a group are supplied with electric power in a period between maximum expansion of a bubble in a previously driven group and expiration thereof.

According to a further aspect of the present invention, there is provided an ink jet recording apparatus for an ink jet recording apparatus comprising: a plurality of electrothermal transducer elements for producing thermal energies for formation of recording liquids; and driving means for supplying electric energy to the electrothermal transducer elements in accordance with data to be recorded and a control signal, wherein the plural electrothermal transducers are grouped into plural groups, and the groups are simultaneously driven by the driving means, wherein the electrothermal transducer elements in a group are supplied with electric power in a period between maximum expansion of a bubble in a previously driven group and expiration thereof.

According to the present invention, the printable frequency is increased, and the deviation of the ink shot positions are improved, and therefore, the print quality is improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 8:
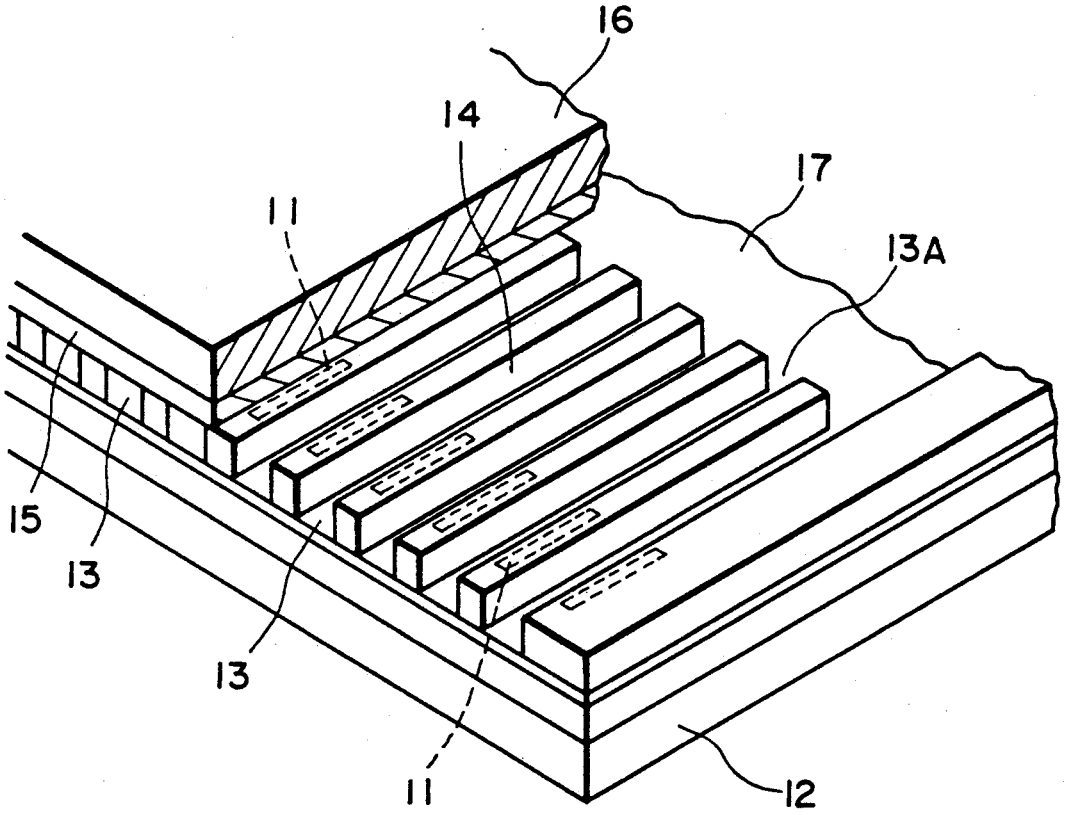
FIG. 8 is a sectional view of a recording head usable with the present invention.

FIG. 8 is a perspective view of an ink jet recording head to which the present invention is applicable. Designated by a reference numeral 11 is a heat generating portion (heat generating element) of an electrothermal transducer producing thermal energy contributable to ejection of the recording liquid (ink) by creating a bubble, when the electrothermal transducer is supplied with electric energy. The heater 11 is formed on a substrate 11 through a process similar to semiconductor manufacturing processes. The recording head further comprises ejection outlets (orifices) 13 through which the recording liquid is ejected, ink passages (nozzles) 14 communicating with the respective ejection outlets 13, and ink passage constituting member 15 for constituting the ejection outlets and the ink passages 14.

The recording head further comprises a top plate 16, a common liquid chamber 17 commonly communicating with the ink passages 14, and is effective to accommodate the ink supplied from an unshown ink supply source.

Figure 3:
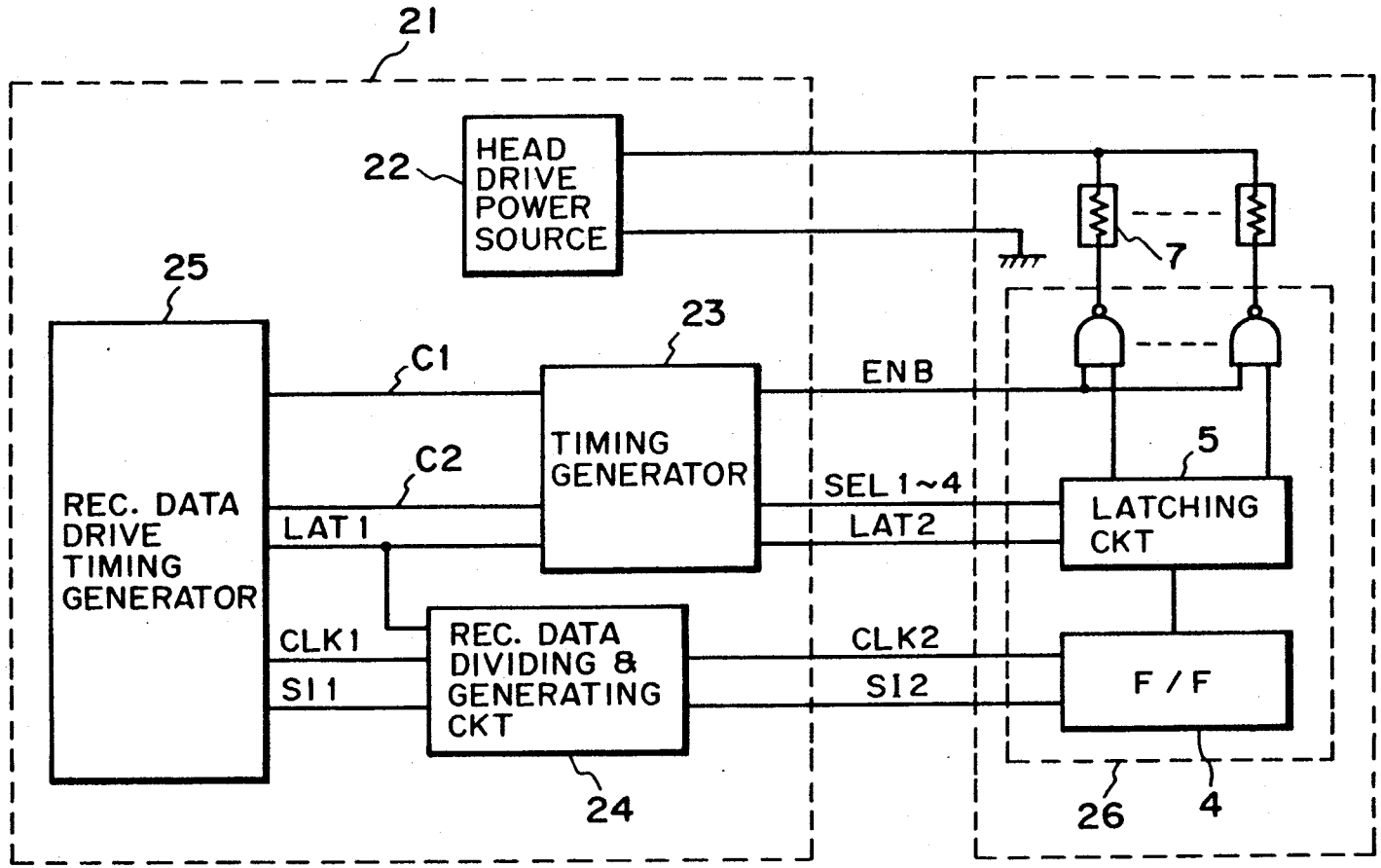
FIG. 3 is a block diagram of a control system used in an apparatus according to an embodiment of the present invention.

FIG. 3 is a block diagram of an example of a drive control system for the ink jet recording head having a structure shown in FIG. 8. The control system comprises a head driving circuit 21, a head driving source 22, a timing generating circuit 23, a recording data dividing circuit 24, a recording data drive timing generating circuit 25. The timing generating circuit 23 is responsive to the data to be recorded and control signals C1 and C2 from the drive timing generating circuit 25 to generate a pulse width setting signal ENB and selection signals SEL1, SEL2, SEL3 and SEL4 for selecting the latching positions of the input record data to select the electrothermal transducer elements to be driven and to produce a latching signal LAT2. The record data dividing circuit 24 extracts and reforms the record data for one line to supply it to the recording head driver IC26.

Figure 4:
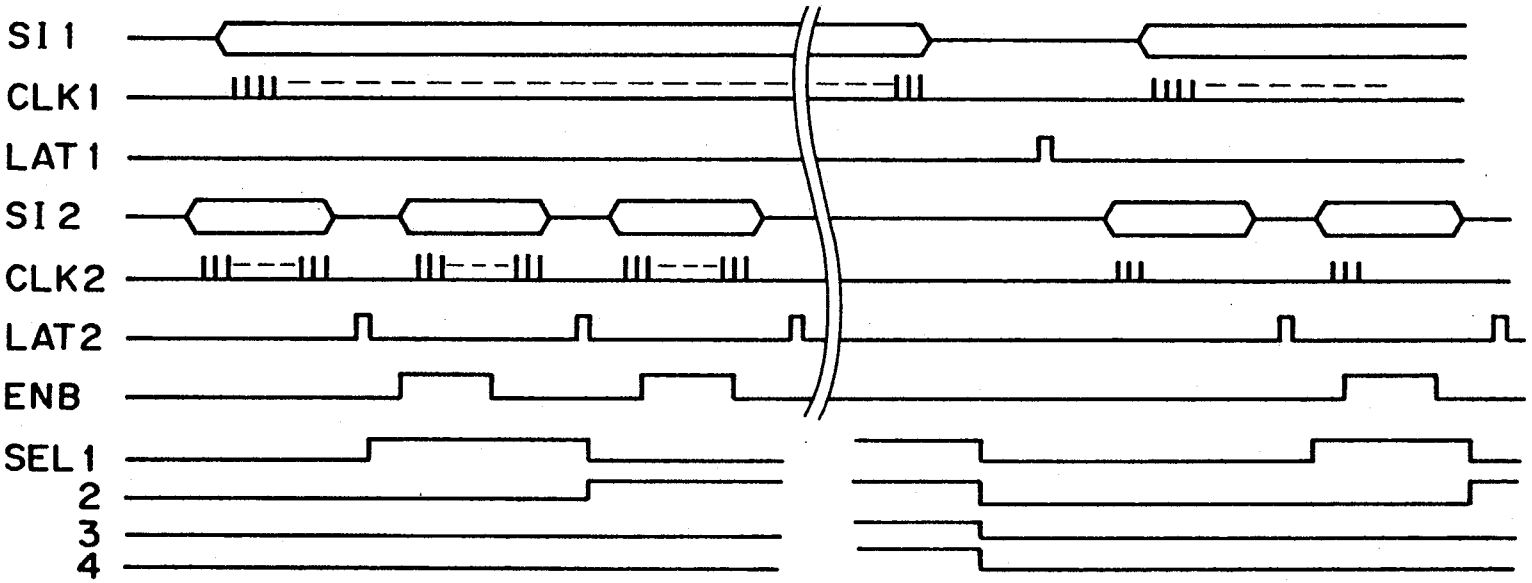
FIG. 4 is a drive timing chart by the circuit shown in FIG. 3.

FIG. 4 shows the drive timing in this embodiment. The record data SI1 for one line constituted by the same bit number as the number of electrothermal transducer elements are reintroduced into record data SI2 corresponding to the electrothermal transducer elements which are simultaneously driven by the record data dividing circuit, and are transferred to the recording head. Thereafter, the data are read in the latching circuit in the driver IC selected by the selection signals SEL1–SEL4 in accordance with the input of the latching signal LAT2. Then, the electrothermal transducers selected by the input of the ENB signal are supplied with the electric energy. The data transfer, selection signal application and the pulse width setting signal application are repeated for a predetermined number of times to effect the printing for one line.

Figure 2A:
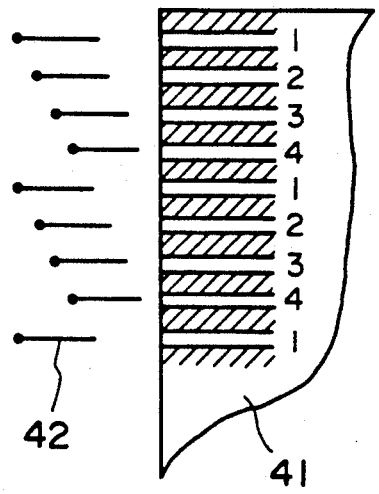
FIGS. 2A and 2B illustrate an example of drive timing according to an embodiment of the present invention.
Figure 2B:
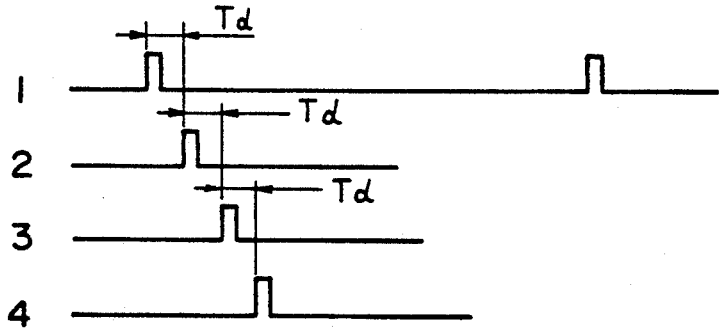

FIG. 2 illustrates the order of nozzle drives in this embodiment. The ink jet recording head 41 ejects the recording droplet 42. The nozzles of the ink jet recording head are grouped into four groups. As shown in the Figure, the electrothermal transducers therefor in each of the groups are driven in the order of No. 1, No. 2, No. 3 and No. 4 with a time difference Td.

Figure 1:
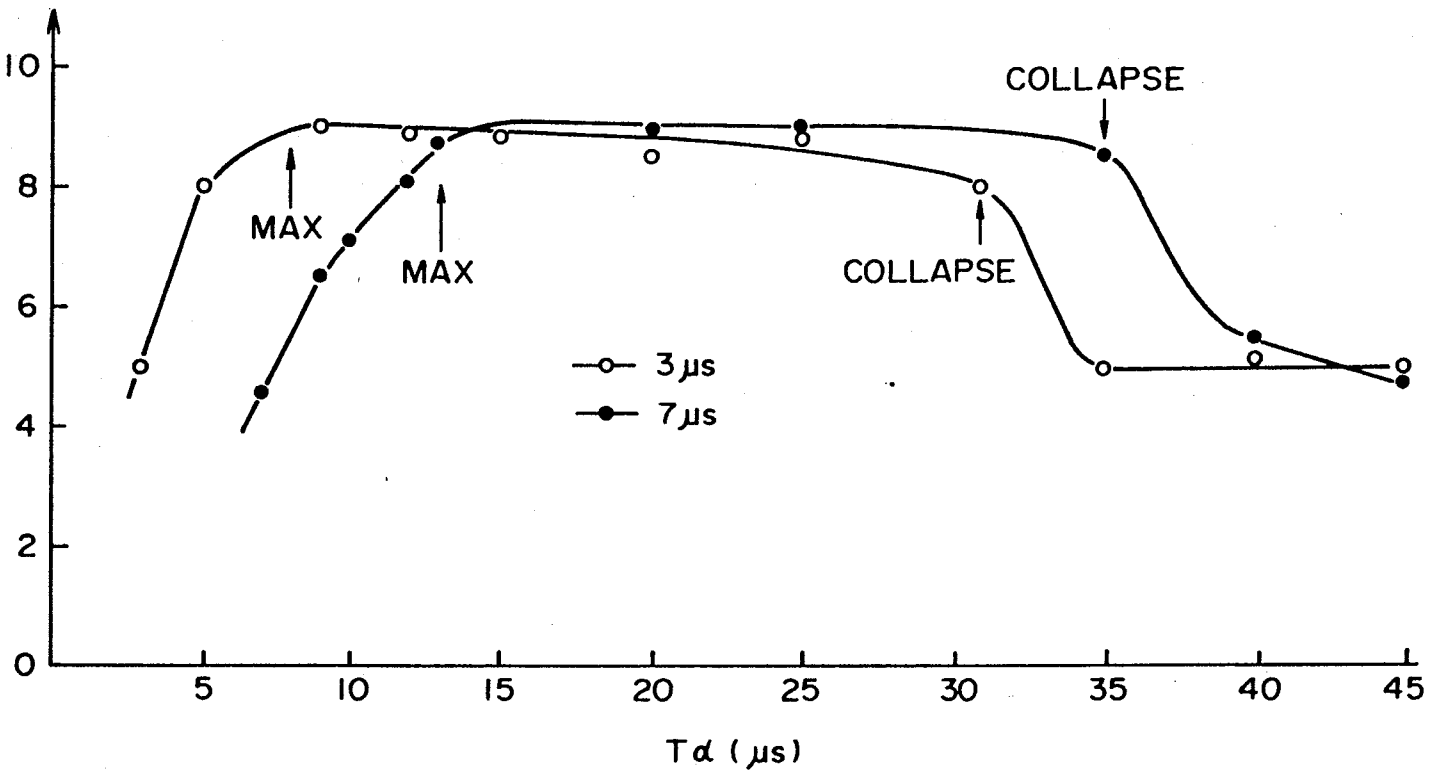
FIG. 1 is a graph showing a relation between a response frequency and a time difference between driving pulses.

FIG. 1 shows the relation between the drive pulse time difference Td of the electrothermal transducers in a group and an average response frequencies of the nozzles (measured on the basis of all ejections). As will be understood from the Figure, the response frequency is substantially maximum within a range between a maximum bubble expansion and collapse and expiration thereof. Therefore, at the time of maximum size of the bubble, the next electrothermal transducer is preferably supplied with the electric energy, since then the response frequency of the nozzles is improved.

As will be understood from FIG. 1, the points of time for the maximum expansion of the bubble and the points of the time for the collapse of the bubble are different if the driving pulse width is different (3 micro-sec and 7 micro-sec). Therefore, noting the formation of the bubble, the meniscus vibrates reciprocally in the liquid passage after the expiration of the bubble in the sequential drive. The reciprocation is influential to adjacent nozzle or nozzles. Therefore, if the next drive is started during the period in which the ink flow in the previously driven passage is in one direction, the response frequency is increased, and the ejection is stabilized, because the instability factor is significantly reduced.

The further preferable condition will be considered. Even in the above preferable range, the response frequency decreases if the time difference Td is further longer. In addition, the positions of the shots of the recording liquid droplets are slightly deviated, and therefore, the printing quality is slightly deteriorated. The experiments using 64 nozzle head capable of printing at 360 DPI, wherein the nozzles are grouped into four groups each including 16 nozzles and are printed at 6.5 KHz with the pulse width of 3 micro-sec, have revealed that a part of the shot positions are slightly deviated if the time difference Td exceeds 20 micro-sec. If the time difference Td exceeds 25 microns, the deviation is remarkable.

Therefore, the further preferable condition is that the time difference is not more than 20 micro-sec, and particularly preferably not more than 20 micro-sec. The upper limit is the maximum bubble expansion point in the previous drive.

Further detailed investigations of the ejected liquids, have revealed that in the process of columnar ejection of the liquid through the ejection outlet due to the bubble formation, the wetting of the periphery of the ejection outlet by the liquid is unavoidable. However, the wetting is smaller than conventional method or apparatus. The wetting is relatively small after 4 micro-sec elapses from the maximum expansion of the bubble, and particularly, it is smaller after 10 micro-sec elapses thereafter. On the other hand, it is relatively large before 4 micro-sec elapses after the maximum expansion of the bubble. It is considered that if the heat generating element is supplied with electric energy before approximately 4 micro-sec elapses from the maximum bubble expansion by the previously energized heat generating element, the wetting remains around the ejection outlet previously actuated, and the wetting slightly influences the ejection direction of the next ejection. This has been observed in a part of the ejection outlets.

From the foregoing, in order to maintain the high frequency even when a large number of nozzles are actuated, it is preferable that the energization starts in a period from the maximum expansion and the collapse or expiration of the bubble provided by the previous energization. Further preferably, the energization is started after 4 micro-sec elapses from the maximum expansion, or further preferably after 10 micro-sec elapses thereafter.

Figure 7:
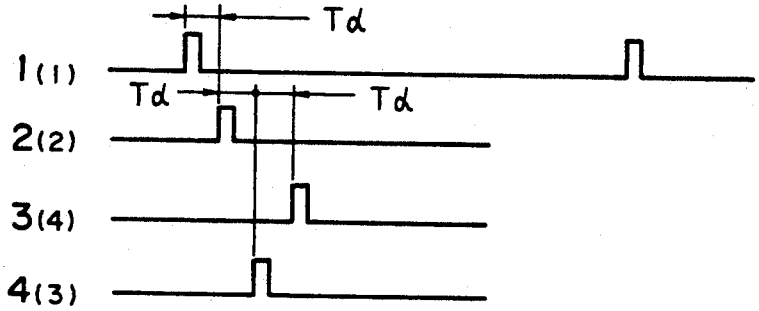
FIG. 7 shows a drive signal timing in another example.

In place of the driving system of FIG. 4, the electrothermal transducers are supplied with driving pulses in the order of 1, 3, 2 and 4, or as shown in FIG. 7, they may be driven in the order of 1, 2, 4 and 3. In those cases, the response frequency can be improved by starting application of energization pulse in the period between the maximum bubble expansion to the collapse of the bubble.

As described in the foregoing, according to the present invention, the plural electrothermal transducer elements are grouped into n groups in each of which the electrothermal transducers are simultaneously driven, and the groups are sequentially driven with a time difference. The electrothermal transducers in a given group are simultaneously driven in a period from the maximum expansion of the bubbles in the previously energized group to the collapse or expiration of the bubbles thereof.

Because of this feature, the following advantageous effects are provided:

(1) The frequency at which the recording liquid droplets can be ejected when the nozzles are simultaneously driven, so that the recording speed can be increased.

(2) The possible adverse influence to the shot position accuracy due to the significant wetting of the ejection outlet of the adjacent nozzles, can be prevented, so that the print quality is improved.

Figure 5:
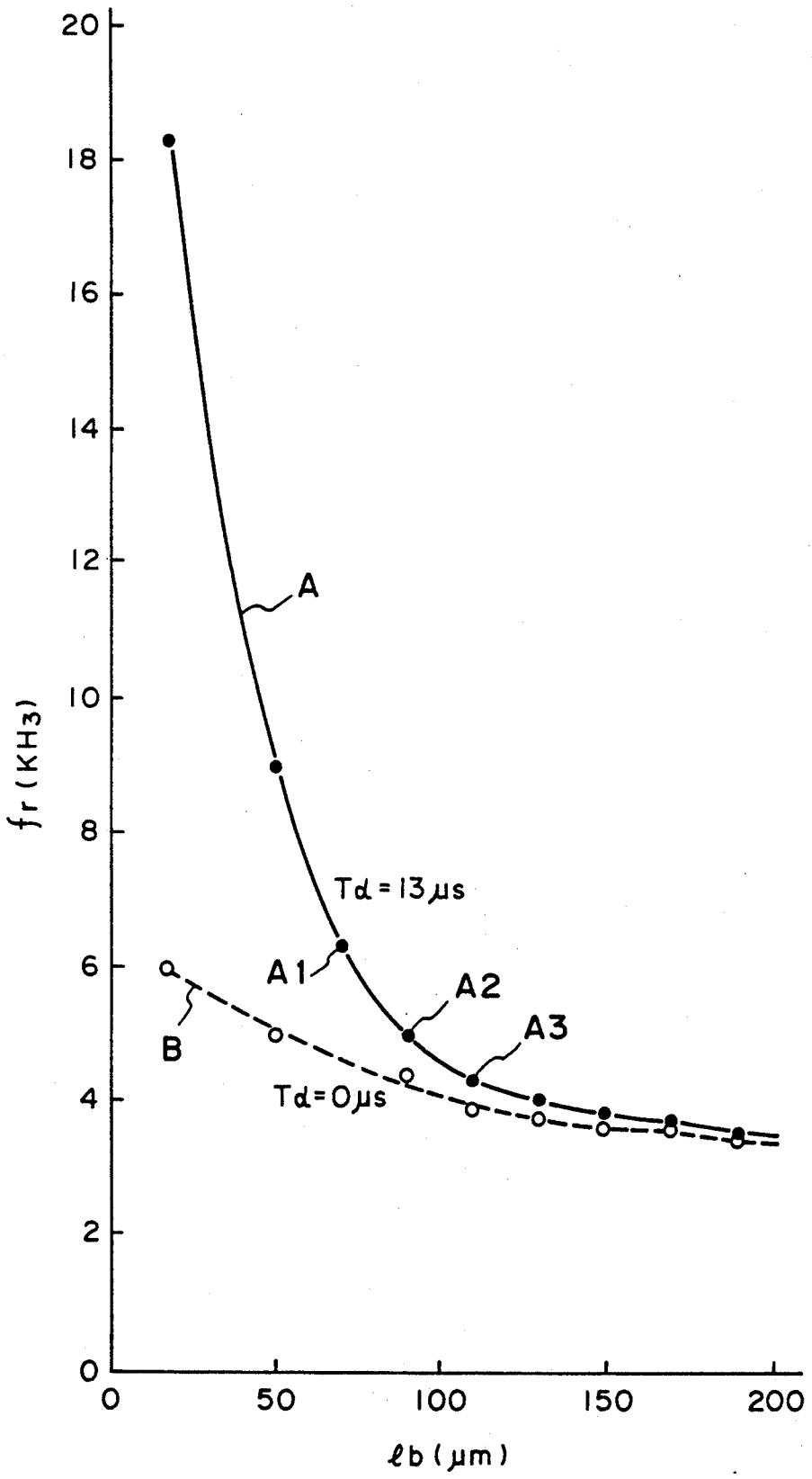
FIG. 5 is a graph illustrating advantageous effects by the liquid passage structure usable with the present invention.

Referring to FIGS. 5–7, the further preferable conditions will be described.

Figure 6A:
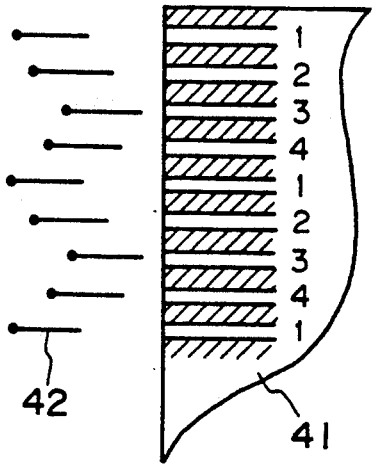
FIG. 6A is a sectional view of a recording head according to another embodiment of the present invention, illustrating the time sharing drive.
Figure 6B:
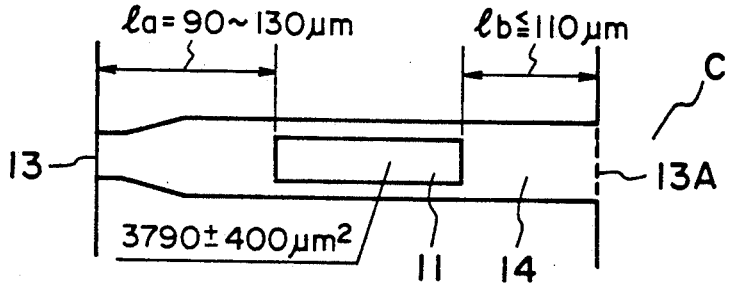
FIG. 6B is a sectional view illustrating a liquid passage communicating with a common liquid chamber.

Referring to FIGS. 6A, 6B and 7, the major part of the embodiment of this invention will be described. The ink jet recording head 41 ejects the ink droplet along a path 42. In the Figure, the nozzles of the ink jet recording head are grouped into four groups. As shown in FIG. 7 by the driving pulses, the electrothermal transducers for the passages are sequentially driven with the time difference Td in the order of No. 1, No. 3, No. 2 and No. 4. The numerals in the parentheses in FIG. 7 designate the order of drive in each of the groups of electrothermal transducer element. In this embodiment, the first electrothermal transducer is driven; and then the second electrothermal transducer is driven (time difference Td between adjacent pulses). With the same timing, the fourth electrothermal transducer is driven, and the third electrothermal transducer is driven. Therefore, adjacent electrothermal transducers are not driven within each of the groups and between adjacent groups.

FIG. 6B is a sectional view of an ink passage of an ink jet recording head, showing a planar heat generating element 11, wherein the ejection outlet is smaller than the liquid passage in the cross-sectional area. In the Figure, the area of the heat generating element is 3790.5 micron$^2$ (133×28.5), for example. A distance La from a downstream end of the heat generating element to the orifice with respect to the direction of ejecting flow of the ink, is 120 microns. The recording head is of a type wherein the direction of the ejection of the ink is substantially parallel with the heat generating surface. However, when they are not parallel, the present invention applies by defining the distance La as the minimum distance between the ejection outlet 13 and the heat generating element 11. As will be understood, the definition is generic to both of the types. A distance from an upstream end of the heat generating element to an upstream end of the ink passage (supply port 13A) Lb with respect to the direction of the flow of the ejecting ink has been found to be significantly influential to the frequency of the recording droplet formation, and therefore, the printing speed.

The distance Lb is the minimum distance between the supply port 13A and the heat generating element 11.

Referring to FIG. 5, the description will be made as to the distance Lb. FIG. 5 is a graph showing a relation between a meniscus restoring frequency $f_r$ (refilling frequency) and the distance Lb when all of the nozzle are simultaneously actuated or driven. The solid line in this graph represents the frequency $f_r$ when the heat generating elements of FIG. 6 are sequentially driven in the order of the arrangement thereof with the rest period Td 13 micro-sec in the time sharing drive. The broken line in the graph represents the frequency $f_r$ when the time difference Td is 0, that is, the heat generating elements are driven in a non-time-sharing fashion.

It will be understood from this Figure that the frequency $f_r$ increases with decrease of the distance Lb, and particularly that the frequency $f_r$ abruptly increases in the region Lb≦110 microns. Additionally, the frequency $f_r$ can be significantly increased by using the time difference Td=13 micro-sec, as compared with the simultaneous drive. This is because of the crosstalk among the nozzles. The increase rate by using the time sharing drive is larger if the distance Lb is shorter, that is, the influence of the crosstalk is stronger.

On the line A, a plot A1 indicates 6.3 KHz at 70 microns; A2, 5 KHz at 90 microns; A3, 4.35 KHz at 110 microns. The tendency is similar in the case of the driving order shown in FIGS. 7A and 2.

From the foregoing, it will be understood that in the ink jet recording head driven in the time sharing fashion for the adjacent nozzles, the frequency $f_r$ is increased, and that the frequency is a significantly increased by satisfying Lb≦110 microns, so that the recording speed is remarkably improved.

Further preferably, the distance Lb is not more than 70 microns, since then the frequency is larger than the frequency in the case of the simultaneous driving. The distance La is preferably 120 microns in this case.

The description will be made as to the distance La. It has been found that there is an optimum distance La. If the distance La is much smaller than 130 microns, the following problems arise:

(1) When the meniscus retracts after the ejection of the recording liquid, the bubble which is in the process of collapsing contacts the meniscus with the result that the external gases are introduced into the nozzle, which leads to liquid ejection failure; and this occurs in a time period of 25–35 micro-sec from the application of the ejecting pulse:

(2) When the size of the bubble reaches its maximum, the leading edge of the bubble penetrates through the orifice with the result of introduction of the external gases into the nozzle, which leads to ejection failure; and this occurs in a time period of 5–15 micro-sec from application of the ejection pulse energy.

The above phenomena occur in the region of La<90 microns, and therefore, the distance La is preferably not less than 110 microns.

When the distance La is much larger than 130 microns, the following problems arise:

(1) The impedance against flow of the recording liquid in the ejecting direction from the center of the heater is increased with the result of decreased ejection speed of the recording liquid, which leads to the degrading of the accuracy in the position of the shot of the liquid on the recording medium and therefore to the deterioration of the quality of the image recorded; and (2) The above increase of the impedance results in the lower quantity of the ejected recording liquid, with the result of the lower image density of the print on the recording medium, and therefore, the deterioration of the image quality.

These phenomena occur in the region of La>130 microns, and therefore, the distance La is preferably not more than 130 microns.

As regard the relation between the distances La and Lb, the distance La is preferably larger than the distance Lb, since then, the quantities of the ejected liquid is uniform.

Further preferably, all of the above-described conditions La>Lb, 90≦La≦130 (microns) and Lb≦110 (microns) are satisfied, since then all of the above advantageous effects are provided.

The advantageous effects of the present invention are provided even if the sequentially driven electrothermal transducers are not adjacent, but if they are closely arranged (nozzles 1 and 3, 2 and 4 in FIGS. 7A and 7C; nozzles 2 and 4 in FIGS. 8A and 8C). The advantageous effects are remarkable particularly when the distance between centers of the heat generating portions of the electrothermal transducers simultaneously driven is not more than 100 microns, further particularly when it is not more than 80 microns.

The advantage of the present invention increases with increase of the number of groups of liquid passages and therefore electrothermal transducers. Particularly when the number of groups is not less than 48, the difference between the simultaneous drive and the drive in accordance with the present invention is remarkable. Also, the present invention is particularly advantageous when the ejection outlets are arranged at high density. From the standpoint of the stabilization of the ejecting performance, the heat generating surface area of the heat generating element is preferably not more than 4190 micron$^2$ and not less than 3390 micron$^2$.

The description will be made as to the apparatus capable of continuously operating for very long period in a stabilized manner. When the distance Lb is very small, the vibration of the meniscus resulting from the restoring the meniscus to the orifice after the ejection of the recording liquid increases, by which the orifice is wetted with the liquid in some cases after long term recording operation. If this occurs, the straight directivity of the recording liquid is deteriorated by the wetting with the result that the accuracy in the positions of the shot deposition on the recording material is slightly deteriorated. In order to stabilize the recording liquid ejection by avoiding the above, it has been found that Lb≧40 microns is preferable. In addition, it is preferable that the configuration of passage is the same as shown in FIG. 1 from the inlet port to the heat generating element.

In the case of the nozzle having a flow resistance element upstream of the heat generating element for reducing the ink passage area for the purpose of flow of the ink toward upstream, the printing quality is guaranteed over a range having a smaller distance Lb, as compared with the nozzle shown in FIG. 1B, by the increase of the impedance by the flow resistance element. More particularly, if Lb≧30 microns, the good printing is assured for a long period of time at a high printing speed.

The driving pulse of the driving signal in this embodiment preferably has the major disclosed in U.S. Pat. Nos. 4,463,359 and 4,345,262. Further preferably, the conditions disclosed in U.S. Pat. No. 4,313,124 relating to the temperature increase of the heat generating surface are used.

The advantageous effects of the present invention are significant when the present invention is used in a full-line type recording head. The full-line recording head may be of a type of plural recording heads covering as a whole the entire length of the maximum recording line, and a type wherein one recording head covers the entire line.

The present invention is applicable to the recording head of a exchangeable chip type wherein when the chip is mounted, it is electrically connected with the apparatus and it is capable of being supplied with the recording liquid from the main apparatus, or a cartridge type recording head having an ink supply source.

The present invention is particularly advantageously usable with an ink jet recording apparatus or head wherein the print data to the plural electrothermal transducer elements are divided and transferred for each plurality of bits, and the adjacent electrothermal transducers are driven with time difference sequentially.

As described in the foregoing, according to the present invention, the actuable recording frequency can be increased, and therefore, the recording speed can be increased.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method for an ink jet recording apparatus comprising a plurality of electrothermal transducer elements for producing thermal energy for ejection of recording liquid and driving means for supplying electric energy to the electrothermal transducer elements in accordance with data to be recorded and a control signal, wherein the plural electrothermal transducer elements are grouped into plural groups, and the electrothermal transducer elements in each group are simultaneously driven by the driving means, wherein the electrothermal transducer elements in a group are supplied with electric power in a period between maximum expansion of a bubble in a previously driven group and expiration thereof.

2. An ink jet recording apparatus comprising:

a plurality of electrothermal transducer elements for producing thermal energy for ejection of recording liquid; and driving means for supplying electric energy to the electrothermal transducer elements in accordance with data to be recorded and a control signal, wherein the plural electrothermal transducer elements are grouped into plural groups, and the electrothermal transducer elements in each group are simultaneously driven by the driving means, wherein the electrothermal transducer elements in a group are supplied with electric power in a period between maximum expansion of a bubble in a previously driven group and expiration thereof.

3. An ink jet recording method for an ink jet recording apparatus comprising a plurality of electrothermal transducer elements for producing thermal energy for ejection of recording liquid and driving means for supplying electric signals to the electrothermal transducer elements, wherein the plural electrothermal transducer elements are grouped into plural groups, and the electrothermal transducer elements in each group are simultaneously driven by the driving means, wherein the electrothermal transducer elements in a group are supplied with electric signals in a period between maximum expansion of a bubble in a previously driven group and expiration thereof.

4. An ink jet recording apparatus comprising:

a plurality of electrothermal transducer elements for producing thermal energy for ejection of recording liquid; and driving means for supplying electric signals to the electrothermal transducer elements, wherein the plural electrothermal transducer elements are grouped into plural groups, and the electrothermal transducer elements in each group are simultaneously driven by the driving means, wherein the electrothermal transducer elements in a group are supplied with electric signals in a period between maximum expansion of a bubble in a previously driven group and expiration thereof.

* * * * *

UNITED STATES PATENT AND TRADEMARK OFFICE

CERTIFICATE OF CORRECTION

PATENT NO. : 5,214,450

DATED : May 25, 1993

INVENTOR(S) : JUNJI SHIMODA

It is certified that error appears in the above-identified patent and that said Letters Patent is hereby corrected as shown below:

TITLE PAGE

IN [56] REFERENCES CITED

Under U.S. PATENT DOCUMENTS, "4,723,129 2/1988 Hara" should read --4,723,129 2/1988 Endo et al.--.

IN [57] ABSTRACT

Line 4, "liquid" should read --liquid and--.

COLUMN 1

Line 64, "problems" should read --problem--.

COLUMN 4

Line 20, "frequencies" should read --frequency--.
Line 48, "using" should read --using a--.

COLUMN 6

Line 54, "a" should be deleted.

COLUMN 7

Line 63, "the" (third occurrence) should be deleted.

UNITED STATES PATENT AND TRADEMARK OFFICE

CERTIFICATE OF CORRECTION

PATENT NO. : 5,214,450

DATED : May 25, 1993

INVENTOR(S) : JUNJI SHIMODA

It is certified that error appears in the above-identified patent and that said Letters Patent is hereby corrected as shown below:

COLUMN 8

Line 16, "the" should be deleted.
Line 20, "major" should read --nature--.

Signed and Sealed this

Thirty-first Day of May, 1994

Bruce Lehman

*Attest:*

BRUCE LEHMAN

*Attesting Officer*

*Commissioner of Patents and Trademarks*